US005610473A

United States Patent [19]

Yokota et al.

[11] Patent Number: 5,610,473

[45] Date of Patent: Mar. 11, 1997

[54] COLOR CATHODE-RAY TUBE

[75] Inventors: Masahiro Yokota, Kumagaya; Tadahiro Kojima; Shuuji Makimoto, both of Fukaya, all of Japan

[73] Assignee: Kabushiki Kaisha Toshiba, Kawasaki, Japan

[21] Appl. No.: 480,295

[22] Filed: Jun. 7, 1995

[30] Foreign Application Priority Data

| | | | |
|---|---|---|---|
| Sep. 9, 1994 | [JP] | Japan | 6-215402 |
| Mar. 24, 1995 | [JP] | Japan | 7-065431 |
| Mar. 24, 1995 | [JP] | Japan | 7-065432 |

[51] Int. Cl.[6] ..... H01J 29/80

[52] U.S. Cl. ..... 313/402; 313/403; 313/404; 313/406; 313/407

[58] Field of Search ..... 313/402, 403, 313/404, 406, 407

[56] References Cited

U.S. PATENT DOCUMENTS 3,601,650 8/1971 Pappadis ..... 313/407

FOREIGN PATENT DOCUMENTS 45-36255 11/1970 Japan .
59-13137 3/1984 Japan .
0077842 3/1989 Japan .
3182034 8/1991 Japan .
4277448 10/1992 Japan .

*Primary Examiner*—Sandra L. O'Shea
*Assistant Examiner*—John Ning
*Attorney, Agent, or Firm*—Cushman Darby & Cushman, IP Group of Pillsbury Madison & Sutro, LLP

[57] ABSTRACT

A color cathode-ray tube comprises a mask unit arranged between a face panel and an electron gun. The mask unit comprises a shadow mask and a mask frame supporting the shadow mask with being applied with tension. The shadow mask is formed of a substantially rectangular thin plate, arranged to face a phosphor screen formed on an inner surface of the face panel, and has a number of electron beam apertures through which electron beams emitted from the electron gun pass. The mask frame comprises a substantially rectangular frame body which has a pair of first sidewalls facing each other and a pair of second sidewalls facing each other, and a pair of mask fixing sections secured to a pair of opposite side edge portions of the shadow mask and extending along the side edge portions. The pair of mask fixing sections extend substantially in parallel with the first sidewalls, respectively and have connecting sections each of which connects a middle portion of the mask fixing section to a middle portion of the corresponding first sidewall.

15 Claims, 11 Drawing Sheets

—x— : T 1 < T 2
—▽— : T 1 > T 2
—o— : T 1 = T 2

COLOR CATHODE-RAY TUBE

BACKGROUND OF THE INVENTION

1. Field of the Invention

This invention relates to a color cathode-ray tube, and more particularly to a color cathode-ray tube with a shadow mask unit comprising a rectangular mask frame and a shadow mask fixed to the mask frame.

2. Description of the Related Art

The color cathode-ray tube is generally provided with an envelope containing a face panel and a funnel, a phosphor screen is formed on an inside face of the envelope and the funnel being attached to the face panel. The phosphor screen is composed of a plurality of phosphor layers that have characteristics of red, green, or blue light. In the neck portion of the funnel is arranged an electron gun which emits three electron beams corresponding to luminous colors. Furthermore, inside the face panel between the electron gun and the phosphor screen, a shadow mask unit is provided which has the function of selecting the electron beams emitted from the electron gun by color and causing the selected beam to strike a phosphor layer of a particular luminous color. The unit is supported by the envelope via holders.

The shadow mask unit includes a shadow mask formed of a substantially rectangular thin plate and a rectangular mask frame to which the peripheral portion of the shadow mask is attached. A number of electron beam apertures through which electron beams pass are made in the shadow mask.

In recent years, there has been an increasing demand that the color cathode-ray tube should have a more flat screen to improve visibility. Furthermore, there has been a strong demand that color cathode-ray tubes used for computer displays and the like should have a higher resolution.

To increase the resolution of the color cathode-ray tube, it is necessary to achieve high minuteness by making the aperture pitch of the shadow mask smaller. Since apertures are made in the shadow mask by etching, it is preferable that a plate of a mask material should be thinner to achieve high minuteness. With respect to the mask's mechanical strength, however, it is desirable for the plate to be thicker. Thus, there have been conflicting demands for the plate thickness of a mask material.

Furthermore, the shadow mask is used to select one of the electron beams emitted from the electron gun so as to project the selected one properly on the phosphor layer of the phosphor screen. To accomplish a high quality of the image appearing on the phosphor screen by electron beam scanning, the shadow mask must be arranged at a predetermined position so as to align with particular positions on the phosphor layer.

The amount of electron beams that pass through the electron beam apertures in the shadow mask and reach the phosphor screen is on the order of 20 to 30% of the total amount of electron beams emitted from the electron gun. The remaining greater part of the electron beams collide with the shadow mask, heating the mask and thermally expanding it. The thermal expansion of the shadow mask is noticeable when a very bright image is displayed all over the screen, or when a very bright image is displayed locally on the screen. The thermal expansion causes the shadow mask to deviate from the phosphor layer, degrading the color purity.

To improve the mechanical strength of the shadow mask and prevent the degradation of the color purity, there is provided a installing method wherein a relatively thin, flat shadow mask is attached to a mask frame while tension is applied to the shadow mask. To be precise, one method is welding a pair of long-side edge portions extending horizontally of the shadow mask to the mask frame, with tension applied to the shadow mask in the vertical direction. Another method is welding both of the long and short side edges of the shadow mask to the mask frame with tension applied to the shadow mask in the horizontal and vertical directions.

However, when the shadow mask is secured to the mask frame with tension applied as described above, there arises a problem: since in a rectangular mask frame, the stiffness of the corner portions of the frame is significantly higher than that of the central portion of each frame sidewall, for example, when in the manufacturing process for cathode-ray tubes, the shadow mask unit is cooled after having passed through a high-temperature furnace and been heated, wrinkles will appear near the corners of the shadow mask.

The mechanism of wrinkles appearing in the shadow mask will be explained. When the shadow mask unit is at high temperatures, both of the shadow mask and the mask frame have expanded thermally. When the unit is cooled, the shadow mask whose thermal capacity is small gets cold earlier and shrink. Such a process causes the mask frame to be pulled by the shadow mask and to become distorted. At this time, the amount of bending of the mask frame is smaller near the frame corners whose stiffness is high, with the result that the corner portions of the shadow mask secured to the frame corner portions are stretched, resulting in plastic deformation. Thereafter, when both of the shadow mask and slack if formed in the mask frame get cold, slack if formed in the portions where plastic deformation has occurred in the shadow mask causing wrinkles in the shadow mask.

Consequently, the alignment of the corner portions of the shadow mask with respect to the phosphor layer is lost, degrading the color purity.

Summary of the Invention

The present invention has been contrived in consideration of the above circumstances, and its object is to provide a color cathode-ray tube wherein the shadow mask has a sufficient mechanical strength without wrinkles resulting from development of the shadow mask.

In order to achieve the object, a color cathode-ray tube according to the present invention comprises: a face panel having an inner surface on which a phosphor screen is formed; an electron gun arranged to face the phosphor screen, for emitting a plurality of electron beams toward the phosphor screen; and a mask unit arranged between the face panel and the electron gun.

The mask unit comprises a shadow mask formed of a substantially rectangular thin plate, arranged to face the phosphor screen, and having a number of electron beam apertures through which the electron beams pass, and a pair of side edge portions facing each other; and a mask frame supporting the shadow mask with tension applied thereto.

The mask frame comprises a substantially rectangular frame body which has a pair of first sidewalls facing each other and a pair of second sidewalls facing each other, and a pair of mask fixing sections secured to the pair of opposite side edge portions of the shadow mask and extending along the side edge portions. The pair of mask fixing sections extend in parallel with the first sidewalls of the frame body, respectively and have connecting sections each of which connects a middle portion of the mask fixing section to a middle portion of the corresponding first sidewall.

With the above configuration, because each mask fixing section is connected at its middle portion to the frame body, it is possible to suppress the effect of the high-stiffness corners of the rectangular frame body on the mask fixing section. Thus, stiffness of each mask fixing section can be constant in the longitudinal direction of the fixing section, thereby preventing wrinkles from developing in the shadow mask.

Furthermore, with a color cathode-ray tube of the present invention, a distal end edge of each mask fixing section is formed into an arcuate shape and each of the side edge portion of the shadow mask is fixed to the distal end edge of the corresponding mask fixing section. Thus, it is possible to support the shadow mask with tension applied to the shadow mask cylindrically. Since the mask frame has slits partially separating each of the mask fixing sections from the frame body, it is possible to adjust tension applied to the shadow mask and suppress a dent in the central portion of the shadow mask. Specifically, by partially separating the mask fixing section from the frame body by means of the slits, the high-stiffness corners of the frame body is prevented from having direct effect on the mask fixing sections, thereby adjusting tension so that a dent in the shadow mask may not take place.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 5, 7 and 8A show a color cathode-ray tube according to an embodiment of the present invention, in which:

FIG. 1 is a sectional view of the entire color cathode-ray tube,

FIG. 2 is an exploded perspective view of a mask unit of the color cathode-ray tube;

FIG. 4 is a plan view showing a method of applying tension with the shadow mask by pulling it, FIG. 5 is a plan view showing a method of applying tension with the shadow mask by compassing the mask frame, FIG. 7 is a graph showing the relationship between distortion and respective positions of a mask fixing section in the states wherein the mask frame has not slit, and the slit has different length, and FIGS. 8A to 8C are plan views showing different states of the shadow mask and the mask frame which are cooled after being heated, respectively;

FIGS. 18 to 19C show a mask unit according to a fourth embodiment of the present invention, in which:

FIG. 18 is a perspective view of a mask frame,

FIG. 19C is a side view of the mask unit, viewed from a direction different from that of FIG. 19B;

DETAILED DESCRIPTION OF THE PREFERRED EMBODIMENTS

There will now be described in detail a color cathode-ray tube according to an embodiment with reference to the accompanying drawings.

Figure 1:
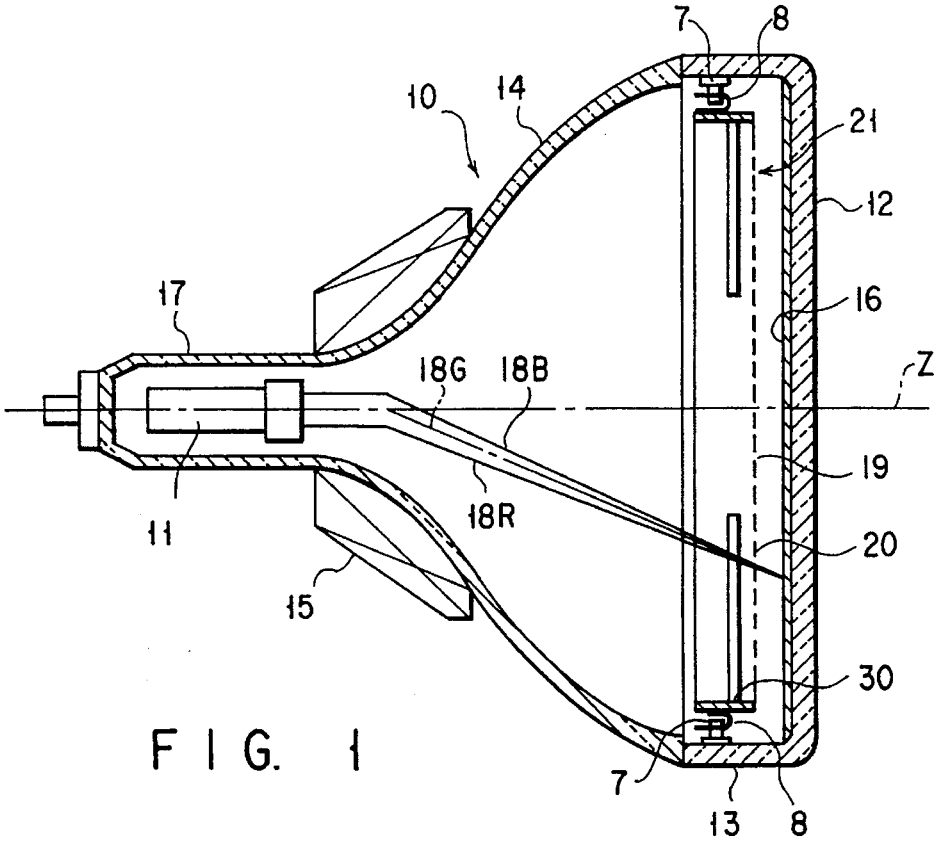

As shown in FIG. 1, a color cathode-ray tube according to the embodiment is provided with a glass envelope 10. The envelope 10 contains a substantially rectangular face panel 12, a skirt section 13 connected the panel, and a funnel integrally bonded with the skirt section 13. Formed on the inner surface of the face panel 12 is a phosphor screen 16 on which phosphor dots luminous red, blue, and green light are arranged regularly. Inside the neck 17 of the funnel 14, there is provided an electron gun 11 that emits three electron beams 18R, 18G, and 18B corresponding to red, green, and blue, respectively. The electron gun 11 is positioned on the tube axis Z of the cathode-ray tube.

Within the envelope 10, a substantially rectangular shadow mask 20 with a number of electron beam apertures 19 regularly arranged is provided in a position where the shadow mask faces the phosphor screen 16 in close proximity with a specific distance between them. The shadow mask 20 has its periphery bonded to a mask frame 30, and, together with the mask frame 30, constitutes a mask unit 21. The mask unit 21 is arranged inside the face panel 12 while mask holders 8 extending from the mask frame 30 are engaged with stud pins 7 fixed on the skirt section 13.

On the outer circumference of the funnel 14, a deflection yoke 15 is provided. The three electron beams 18R, 18G, 18R emitted from the electron gun 11 are deflected by a magnetic field generated by the deflection yoke 15 and selected by the shadow mask 20. By scanning the phosphor screen 16 horizontally and vertically, a color image appears on the face panel 12.

Figure 2:
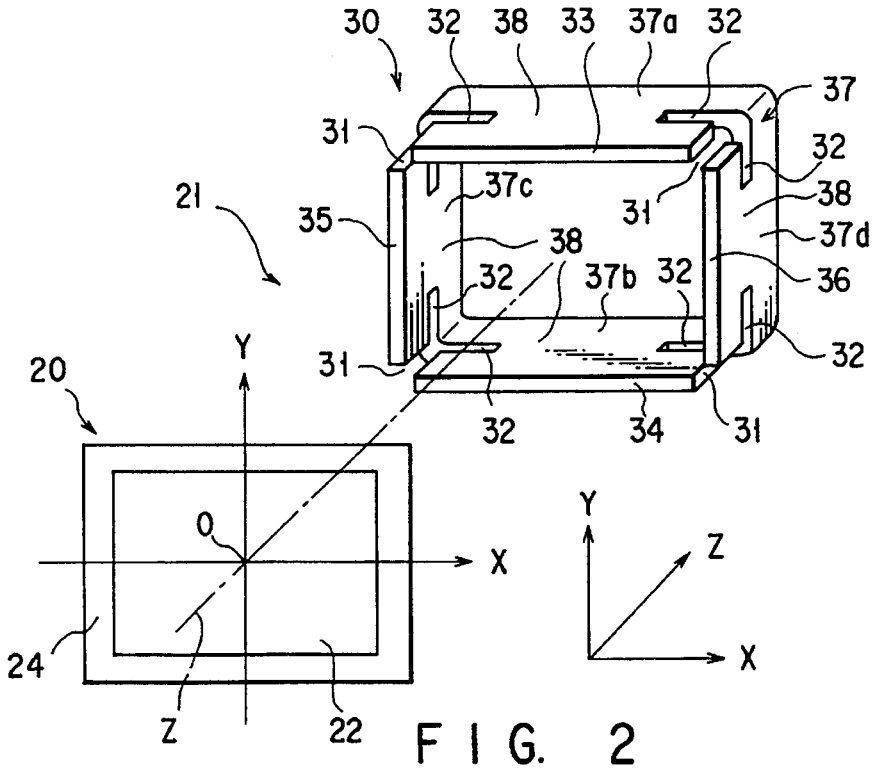

As shown in FIG. 2, the shadow mask 20 is formed of a thin, flat rectangular metal plate, which has the mask center O through which the tube axis Z passes, a pair of long sides parallel to the horizontal axis X, and a pair of short sides parallel to the vertical axis Y. Furthermore, the shadow mask 20 contains a substantially rectangular effective portion 22 where a number of electron beam apertures 19 have been formed through which electron beams pass, and an apertureless portion 24 positioned around the effective portion 22.

Figure 3A:
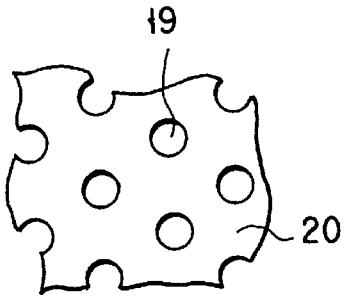
FIG. 3A is an enlarged plan view showing a part of a shadow mask which has circular electron beam apertures.
Figure 3B:
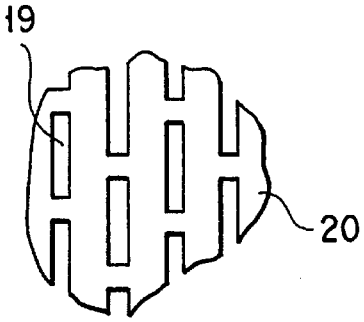
FIG. 3B is an enlarged plan view showing a part of a shadow mask which has rectangular electron beam apertures.

The electron beam apertures 19 are each made round as shown in FIG. 3A. Each electron beam aperture 19 may be formed into a rectangle in such a manner that the apertures are arranged side by side in a predetermined direction as shown in FIG. 3B.

As shown in FIG. 2, the mask frame 30 of the mask unit 21 is formed into a rectangular tube with four sidewalls using a metal plate and is arranged coaxially with the tube axis Z. In each corner of the mask frame 30, a first slit 31 is formed and extends in parallel with the tube axis Z from one end of the mask frame to the middle portion in the axis direction. Furthermore, second slits 32 are formed in the mask frame 30 and extend from the extended end of each first slit 31 in the X and Y directions, respectively.

The formation of the first and second slits 31 and 32 enables the mask frame 30 to have a rectangular frame body 37 with four continuous sidewalls 37*a*, 37*b*, 37*c*, 37*d*, and four separate mask fixing sections 33, 34, 35, 36 extending from the respective four sidewalls of the frame body 37. A pair of sidewalls 37*a*, 37*b* of the frame body 37 facing each other extends in the X direction and a pair of sidewalls 37*c*, 37*d* facing each other extends in the Y direction.

The frame fixing sections 33 to 36 each extend in parallel with the corresponding sidewalls of the frame body 37, and the middle portion of each frame fixing section with respect to the longitudinal direction thereof is connected to the middle portion of the corresponding sidewall by means of a connecting portion 38 defined between the second slits 32.

In the embodiment, the first and second slits 31, 32 are formed so as to have a constant width. The second slits 32 partially separate each sidewall of the frame body 37 from the corresponding mask fixing section. As explained later, by adjusting the width, length, etc. of each second slit 32, the stiffness of the mask fixing section can be adjusted.

The distal end edges of the mask fixing sections 33 to 36 are made flat and straight. The side edge portions of a pair of long sides of the shadow mask 20 are welded to the distal end edges of the mask fixing sections 33, 34, respectively, and the side edge portions of a pair of short sides of the shadow mask 20 are welded to the distal end edges of the mask fixing sections 35, 36, respectively. Furthermore, the shadow mask 20 is secured to the mask fixing sections 33 to 36, being pulled in the X and Y directions, or undergoing tension.

Figure 4:
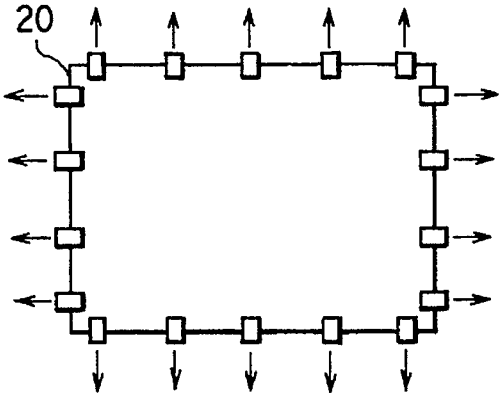
Figure 5:
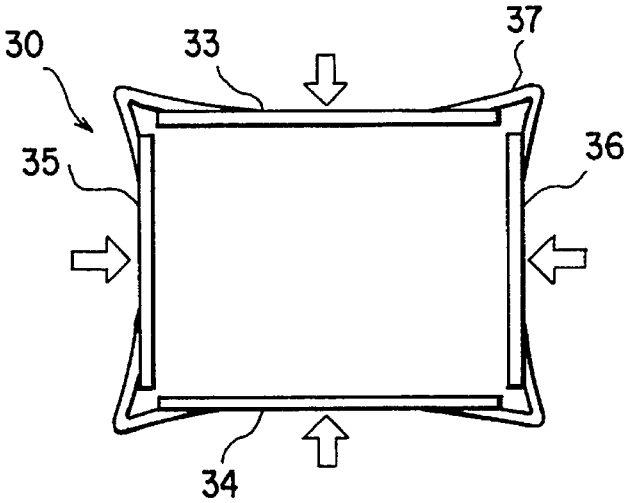

A method of applying tension to the shadow mask 20 includes, for example, a method of pulling the shadow mask 20 with a specific tension in the X and Y directions as shown by arrows in FIG. 4 and in this state, welding the shadow mask to the mask fixing sections of the mask frame 30, and thereafter stopping the application of the tension, and a method of applying compressive force to the mask fixing sections 33, 34, 35, 36 to such an extent that plastic deformation cannot occur in the connecting portions 38 of the fixing sections as shown in FIG. 5 and in this state, welding the respective side edge portions of the shadow mask 20 to the corresponding fixing sections, and thereafter stopping the application of the compressive force.

The mask holders 8 for supporting the mask unit 21 within the envelope 10 are provided on the respective sidewalls 37*a* to 37*d* of the frame body 37.

The stiffness of the mask frame 30 of the mask unit 21 as described above of the mask unit 21 will be described.

Figure 6:
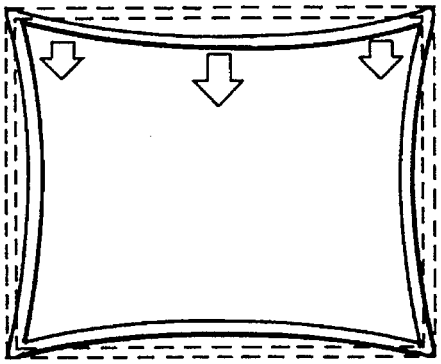
FIG. 6 (PRIOR ART)
FIG. 6 is a plan view showing a conventional mask frame being applied with compression force.

First, when a rectangular mask frame without the first and second slits 31, 32 is considered, for example, both end portions of each frame sidewall along the long sides, or the corner portions of the frame have a higher stiffness than the middle portion of the frame sidewall, because the frame sidewalls along the short sides serve as supports. Therefore, when uniform compressive force is applied externally to the sidewalls of the mask frame as shown in FIG. 6, distortion due to compressive force at both end portions of each of the frame sidewalls along the long sides is smaller than in the middle portion in the frame sidewall.

On the other hand, when only the first slits 31 are formed in the mask frame 30, each of the four mask fixing sections 33 to 36 has both of its end portions separated from the other mask fixing sections. The corner portions of the frame body 37 have a higher stiffness than the middle portion of each frame sidewall and both end portions of each mask fixing section are connected to the corner portions of the frame body where the stiffness is higher. Therefore, both end portions of each mask fixing section are influenced by the corner portions of the frame body 37 and consequently have a higher stiffness than the middle portion of the mask fixing section. As a result, each of the mask fixing sections 33, 34, 35, and 36 causes a difference in stiffness in any position in their longitudinal direction, so that both end portions in the longitudinal direction have a higher stiffness than the middle portion.

In contrast, by forming second slits 32 extending from each first slit 31 toward the middle portion of the two adjacent frame sidewalls as in the embodiment, each mask fixing section, particularly both end portions of each mask fixing section can be separated from both end portions of the corresponding sidewall of the frame body 37, thereby preventing variations in the stiffness of the frame body 37 from affecting each mask fixing section. In the embodiment, by adjusting the length of each second slit 32, or the width of the connecting portion 38, the stiffness of each mask fixing section can be made almost uniform in the longitudinal direction of the mask fixing section.

Figure 7:
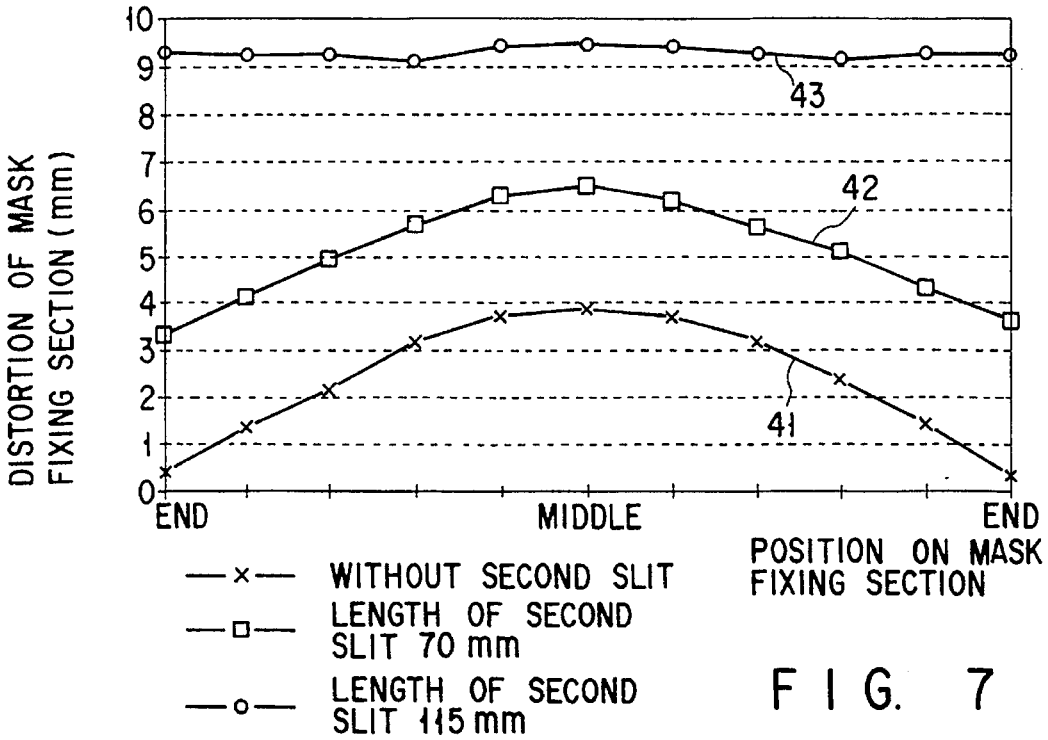

FIG. 7 shows the results of determining the distortion at various parts of the mask fixing section 33 along the long side as the length of the second slit 32 is changed, with uniform compressive force applied vertically (in the Y direction) to the frame body 37 of the mask unit 21 for a 17-inch color cathode-ray tube. In FIG. 7, the horizontal axis indicates each position of the mask fixing section 33, where distortion is measured at intervals of about 30 mm in the longitudinal direction between both ends. Furthermore, the total compressive force is assumed to be 44 kg.

With a conventional mask frame without the second slits, as shown by the characteristic curve 41, the stiffness of both end portions of the mask fixing section 33 is about ten times as high as that of the middle portion (the amount of distortion of the former is one tenth of that of the latter). In contrast, when the second slit 32 is made longer, that is, when the length along the X axis is made larger in FIG. 2, the difference in stiffness between both end portions of the mask fixing portions 33 and its middle portion becomes smaller. When the length of the second slits 32 was determined to be 115 mm, the stiffness at the end portions of the mask fixing section 33 and at its middle portion is almost uniform as shown by the characteristic curve 43. In addition to being uniform, the stiffness distribution can be selected arbitrarily by changing the dimensions and shape of the first and second slits 31 and 32 and the shape of the frame, etc.

As described above, because the stiffness of the individual fixing sections 33 to 36 is almost uniform in the longitudinal direction of the mask fixing section, this prevents wrinkles from appearing in the shadow mask 20 secured to the mask fixing sections 33 to 36 with tension applied to the shadow mask.

Figure 8A:
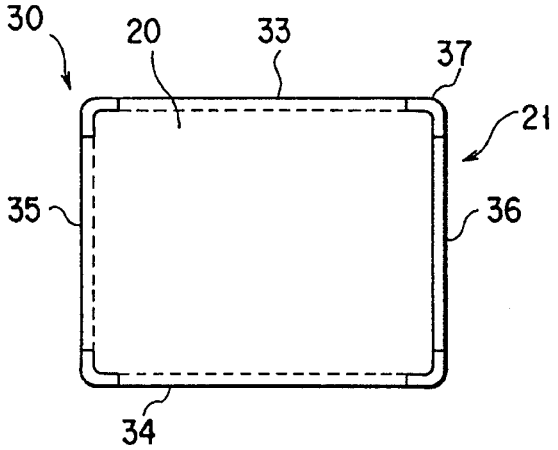
Figure 8B:
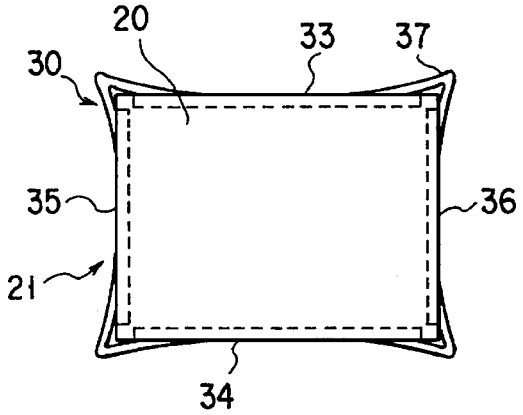
Figure 8C:
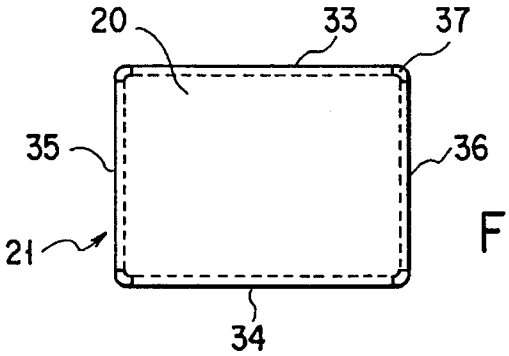

For example, in a case where after the mask unit 21 has passed through a high-temperature furnace and been heated in the process of manufacturing color cathode-ray tubes, it is cooled, both of the shadow mask 20 and the mask frame 30 first expand thermally at high temperatures as shown in FIG. 8A and then, the shadow mask 20 gets cold earlier and shrink in cooling, permitting compressive force to act on the mask frame 30. At this time, as shown in FIG. 8B, because the mask fixing sections 33, 34, 35, and 36 each have a uniform stiffness, the force from the shadow mask 20 causes distortion to occur uniformly over the full length of each mask fixing section. Therefore, when getting cold and shrinking, the shadow mask 20 is not pulled locally, thereby developing no local plastic deformation. Thus, even in a state where both of the shadow mask 20 and the mask frame 30 have been cooled sufficiently, it is possible to support the shadow mask 20 with specific tension applied to the shadow mask, without permitting wrinkles to develop in the shadow mask. This makes it possible to provide a color cathode-ray tube with a high color purity.

Furthermore, since the mask frame 30 is basically rectangular as shown in FIG. 2, it can be manufactured through low-cost press working. Specifically, the respective mask fixing sections 33, 34, 35, and 36 can be formed integrally with the frame body 37 from a sheet of plate material by press working. A dot-type shadow mask 20 with circular electron beam apertures 19 has a lower Young's modulus of elasticity ranging from ⅓ to ⅕ than a shadow mask with long, narrow slit-like apertures and requires lower tension. Therefore, the strength of the mask frame formed by press working suffices to produce a practical mask unit.

For example, in a very thin dot-type shadow mask whose thickness is on the order of 50 μm, the total tension exerted on the mask frame may be as low as less than 40 kg. Therefore, by providing bent reinforcing portions in various places of the mask frame, a mask frame produced by press working from a little less than 2 mm-thick plate material can have a sufficient strength, thereby achieving manufacturing cost reduction. Since mask frames formed of relatively thin plate material are light and have a small thermal capacity, the frame cooling speed is faster and the temperature difference between the shadow mask and the mask frame has less effect.

While in the first embodiment, with tension applied to the shadow mask 20 in both of the X and Y directions, the shadow mask is secured to the mask frame 30, tension may be applied only in either the X direction or the Y direction.

Figure 9:
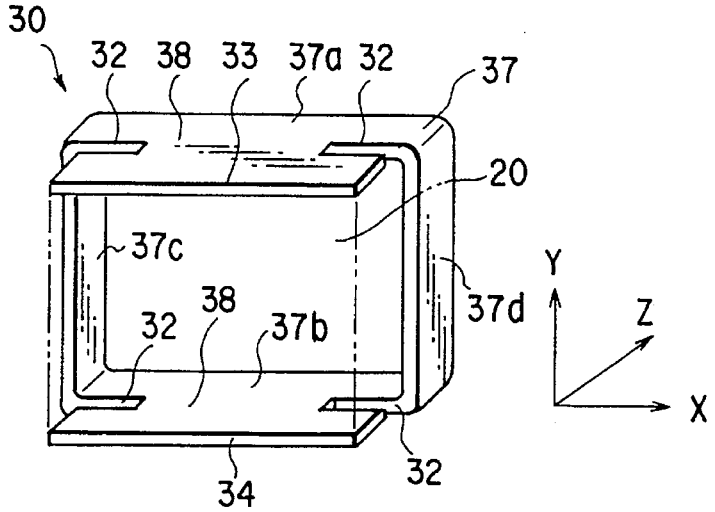
FIG. 9 is a perspective view of a mask unit according to a second embodiment of the present invention.

For example, FIG. 9 shows a mask frame 30 used when tension is applied to the shadow mask 20 in the Y direction only. In this second embodiment, the mask frame 30 has the frame body 37 and the mask fixing sections 33, 34 for the long sides, having no pair of mask fixing sections to which the side edges of the short sides of the shadow mask 20 are secured.

With this configuration, by making second slits 32 extending from both longitudinal-side end portions of each of the mask fixing sections 33, 34 toward the middle portion, the mask fixing sections can be partially separated from the sidewalls 37*a*, 37*b* of the frame body 37 to set the stiffness substantially equally at various positions of the mask fixing section.

Figure 10:
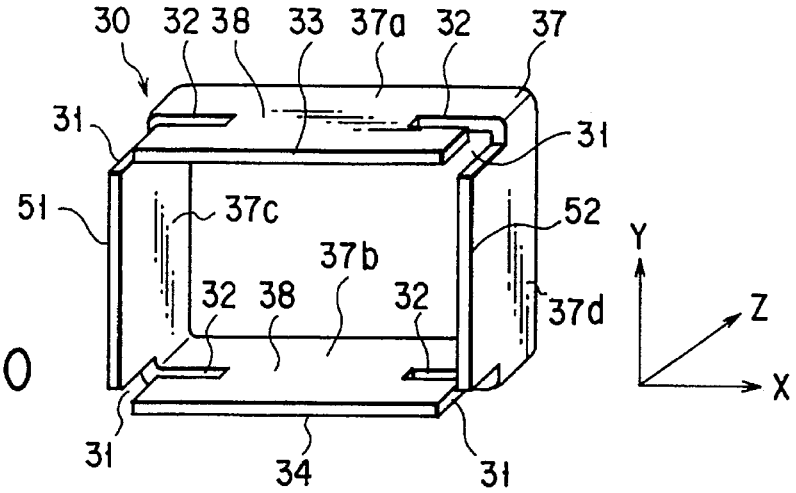
FIG. 10 is a perspective view showing a modification of the mask unit shown in FIG. 9.

Furthermore, in the second embodiment, as shown in FIG. 10, mask contact strips 51, 52 almost as tall as the mask fixing sections 33, 34 may be provided on the sidewalls 37*c*, 37*d* of the frame body 37. The mask contact strips 51, 52 have their distal end edges in contact with the side edges of the short sides of the shadow mask 20 vulnerable to vibration and thereby suppress movement of the shadow mask 20. By connecting the side edges of the short sides of the shadow mask to the mask contact strips 51, 52 via spring members having a small spring constant, vibrations of the shadow mask can be alleviated effectively.

Although the first and second embodiments both use a flat shadow mask supported with being applied with tension, the present invention may be applied to a color cathode-ray tube whose shadow mask is supported in tension cylindrically. When the invention is applied to a color cathode-ray tube with a cylindrical shadow mask, it is possible not only to prevent wrinkles from developing in the shadow mask as in the above embodiments, but also to solve a unique problem arising from the case where a dot-type shadow mask is supported in tension cylindrically, which will be explained later.

Figure 11:
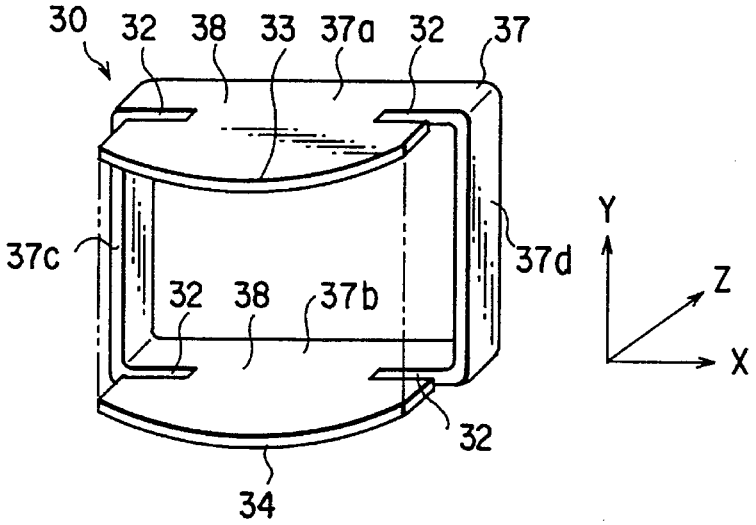
FIG. 11 is a perspective view of a mask unit according to a third embodiment of the present invention.

FIG. 11 shows a mask frame 30 of a mask unit 21 according to a third embodiment of the invention where the invention is applied to a color cathode-ray tube with a cylindrical shadow mask. The mask frame 30, like the mask frame of FIG. 9, comprises a rectangular frame body 37, and a pair of mask fixing sections 33, 34 to which the side edge portions of the long sides of the shadow mask 20 is attached. Each of the mask fixing section 33, 34 has second slits 32 extending from its longitudinal ends toward the middle portion, with the middle portion being connected to the middle portion of the corresponding sidewall of the frame body 37 via a connecting portion 38.

Furthermore, in the third embodiment, the distal end edge of each of the mask fixing sections 33, 34 to which the side edge portions of the shadow mask 20 are secured is formed in an arcuated shape whose central portion is the highest. When the shadow mask 20 is supported in tension cylindrically by the mask frame 30, tension is applied basically in the axial direction of the cylinder, that is, only in the Y-axis direction and the side edge portions of the long sides of the shadow mask 20 are welded to the distal end edges of the mask fixing sections 33, 34, thereby securing the shadow mask 20 to the mask frame 30.

The effect of the mask unit 31 constructed as described above will be explained.

Figure 12:
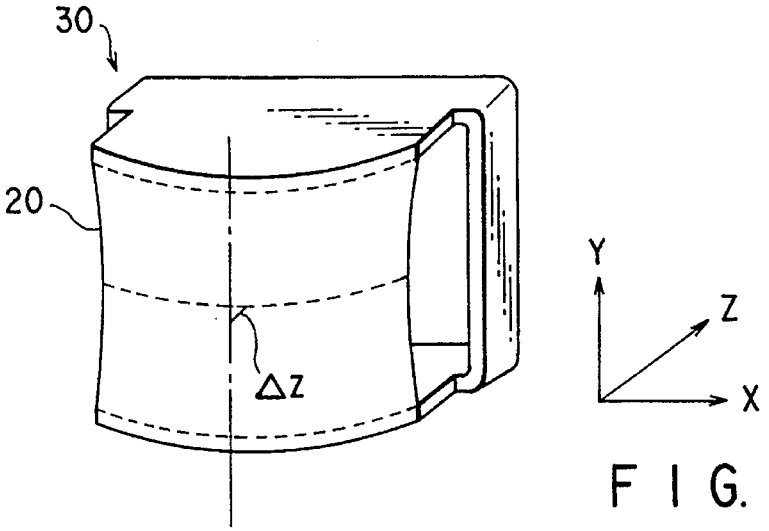
FIG. 12 (PRIOR ART)
FIG. 12 is a perspective view of a conventional mask unit having an arcuated mask unit.
Figure 13:
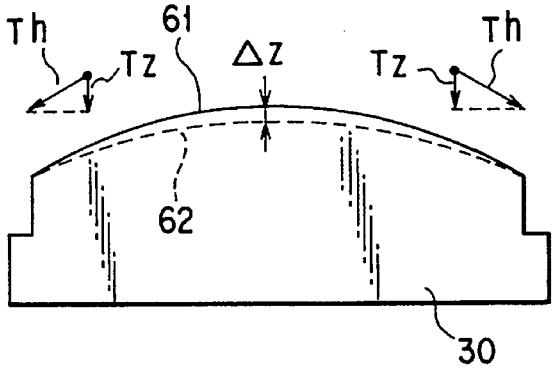
FIG. 13 (PRIOR ART)
FIG. 13 is a side view of the conventional mask unit shown in FIG. 12.
Figure 14:
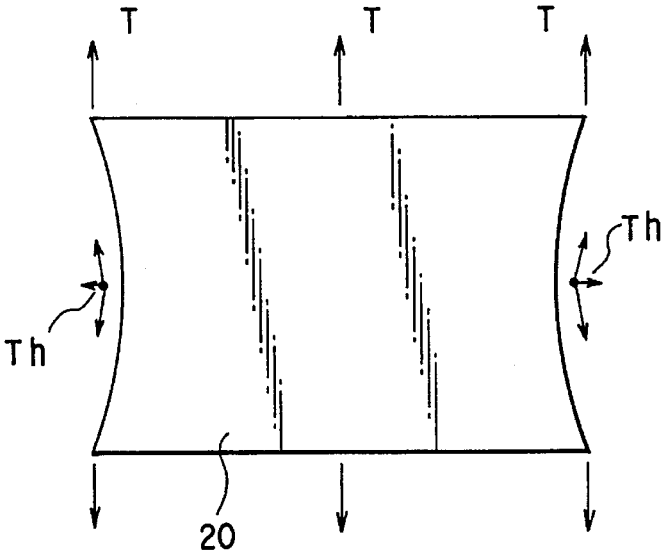
FIG. 14 (PRIOR ART)
FIG. 14 is a plan view showing forces applied to the conventional shadow mask of the mask unit shown in FIG. 12.

As shown in FIG. 12, for example, when a dot-type shadow mask 20 with circular electron beam apertures is supported in tension cylindrically by a conventional mask frame 30 without second slits between the mask fixing section and the frame body, a dent $\Delta z$ develops in the shadow mask 20 at the central portion in the vertical axis direction (the Y direction) as shown in FIGS. 13 and 14. In FIG. 13, a curve 61 indicates the shadow mask curved surface at the distal end edge of the mask fixing section 33, and a broken line curve 62 represents a shadow mask curved surface at the central portion in the Y-axis direction.

The reason why a dent $\Delta z$ develops as described above is that when tension T is applied vertically to the dot-type shadow mask 20 as shown in FIG. 14, a shrinkage develops in the horizontal direction (the X direction) in proportion to an extension in the vertical direction. The shrinkage in the horizontal direction generates horizontal outward force Th in the shadow mask 20, with the result that a tube-axis-direction component Tz in Th causes a dent in the central portion of the shadow mask.

Figure 15A:
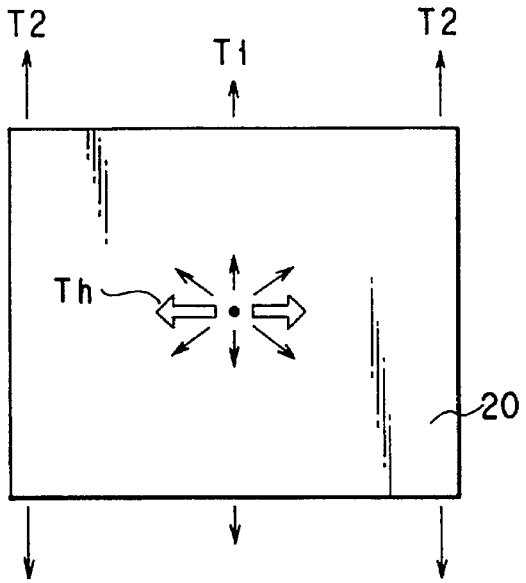
FIG. 15A (PRIOR ART)
FIGS. 15A and 15B are a plan view of the shadow mask and a side view of the mask unit, respectively, in a state wherein tension applied to both ends of the shadow mask is larger than that applied to the central portion of the shadow mask.
Figure 16A:
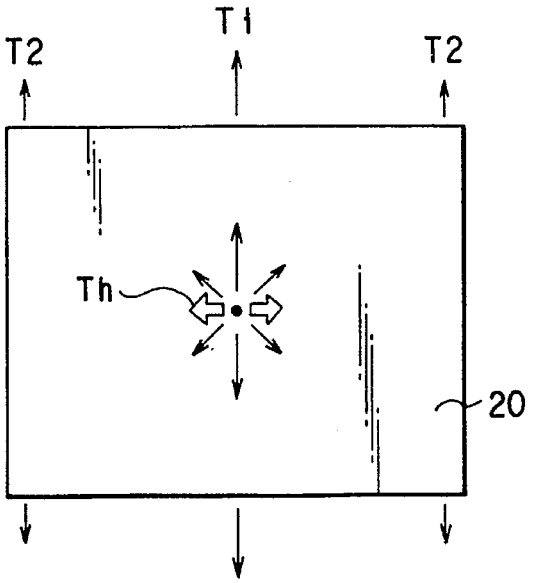
FIGS. 16A and 16B are a plan view of the shadow mask and a side view of the mask unit, respectively, in a state wherein tension applied to both ends of the shadow mask is smaller than that applied to the central portion of the shadow mask.
Figure 15B:
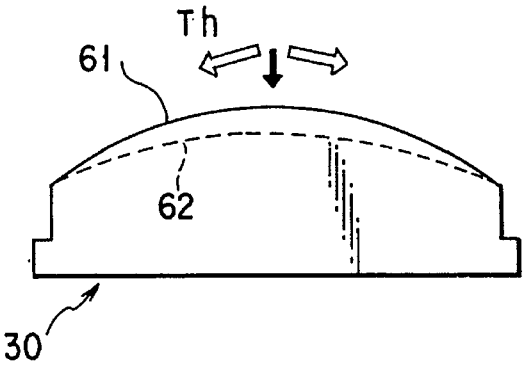
FIG. 15B (PRIOR ART)
Figure 16B:
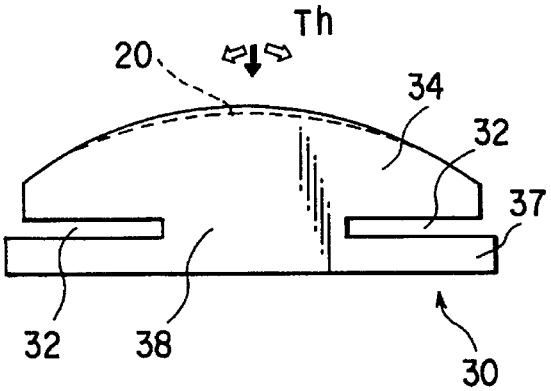

The dent depends on the distribution of tension acting on the shadow mask 20 at various positions in the horizontal direction. Specifically, when tension T1 acting on the middle portion of the long side of the shadow mask 20 and tension T2 acting on both longitudinal end portions of the long side in the horizontal direction meet the expression $T1<T2$ as shown in FIG. 15A, the horizontal outward force Th is greater, with the result that a dent in the central portion of the shadow mask 20 becomes larger as shown in FIG. 15B. In contrast, when the tension distribution meets the expression $T1>T2$ as shown in FIG. 16A, Th is smaller, with the result that a dent in the central portion of the shadow mask 20 is suppressed as shown in FIG. 16B.

Figure 17:
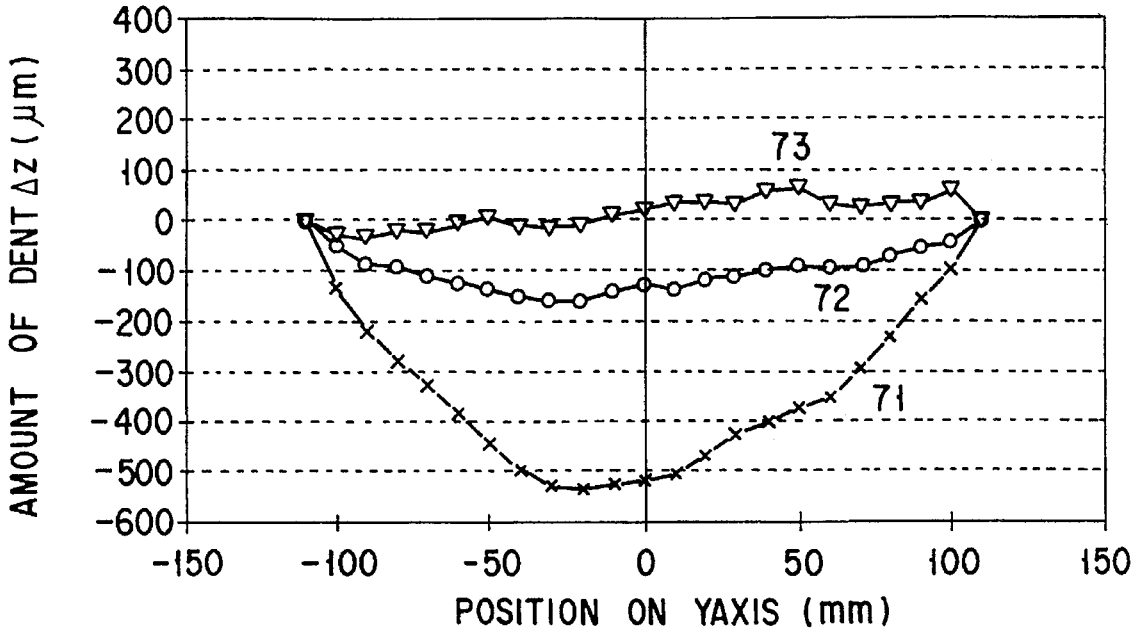
FIG. 17 is a graph showing the relationship between tension applied to respective portions of the shadow mask and the amount of a dent in the central portion of the shadow mask.
Figure 18:
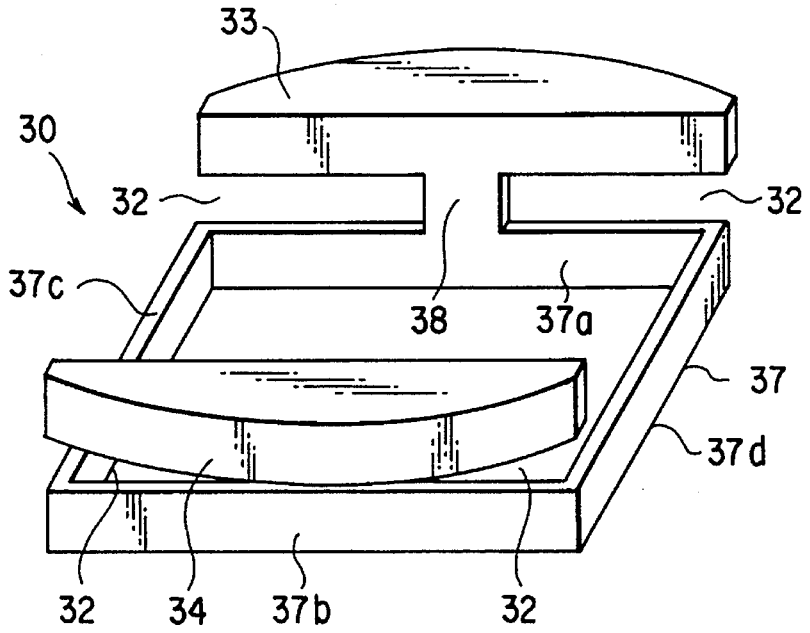
Figure 19A:
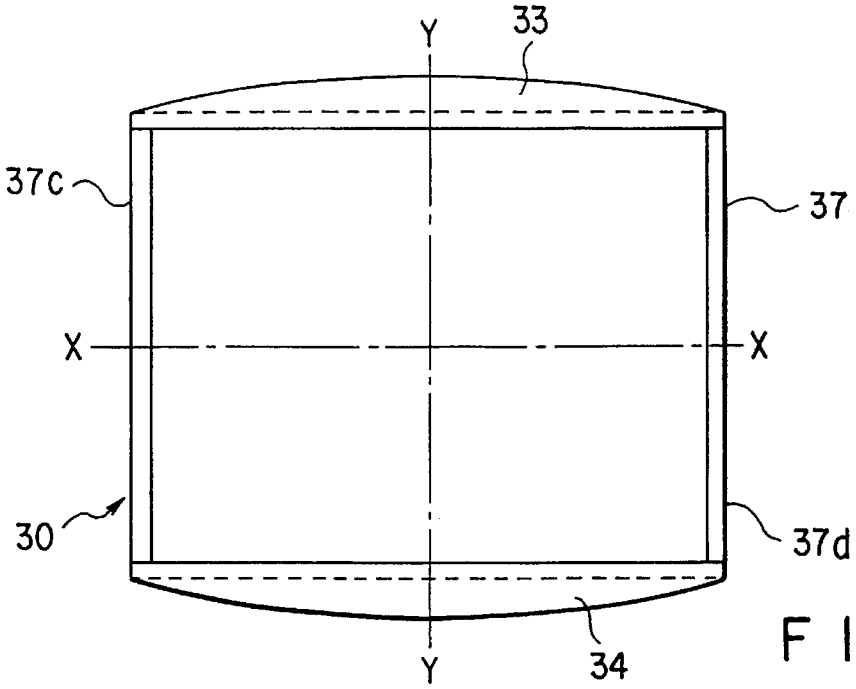
FIG. 19A is a plan view of the mask unit.
Figure 19B:
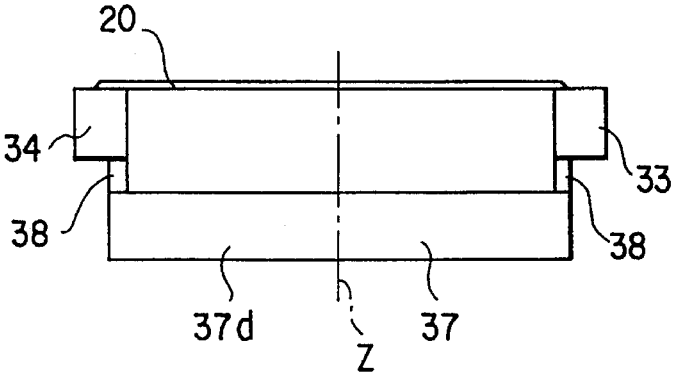
FIG. 19B is a side view of the mask unit.
Figure 19C:
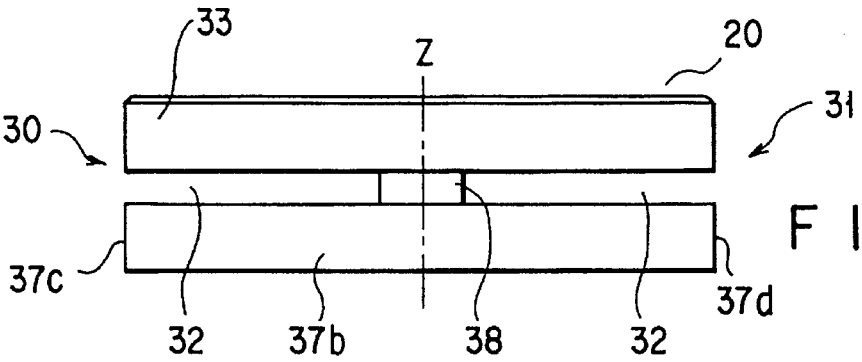

FIG. 17 shows the results of measuring the amount of dent on the vertical axis of the shadow mask when the distribution of tension acting on the long sides of the shadow mask 20 in a mask unit for a 17-inch color cathode-ray tube varies. As seen from this figure, when tension T1 at the horizontal central portion of the long side and tension T2 at both horizontal end portions of the long side meet the expression $T1<T2$, the horizontal tension force Th at the central portion of the shadow mask is greater, with the result that the amount of dent in the shadow mask becomes larger as shown by the characteristic curve 71. When the tension relationship meets the expression $T1=T2$, a dent in the shadow mask 20 is suppressed as shown by the characteristic curve 72.

Furthermore, when tension T2 at the horizontal ends of the long side is made smaller than tension T1 at the central portion, meeting the expression $T1>T2$, horizontal tension Th at the vertical central portion of the shadow mask 20 becomes smaller, which means that a dent is suppressed substantially as seen from the characteristic curve 73. Here, the data in FIG. 17 are based on a mask unit where the mask fixing sections 33, 34 of the mask frame have a length of 330 mm in the X-axis direction and the distal end edge to which the side edge portion of the shadow mask is welded takes the form of an arcuate with a radius of curvature of 1100 mm. Since the amount of dent in the shadow mask 20 depends only on the tension distribution, the amount of dent remains unchanged provided that the distribution is constant even if the total tension is changed.

When the color cathode-ray tube is in operation, the shadow mask 20 is heated by projection of electron beams and expands thermally. With a conventional mask frame having no second slits, when the shadow mask thermally expands uniformly as a result of a temperature rise during projection of beams, tension T2 acting on the shadow mask 20 at both horizontal end portions of the long side which have high stiffness, drops considerably. This permits the tension distribution during shadow mask heating to shift toward the state of $T1>T2$ as compared with the distribution before the heating. As a result, the amount of dent in the shadow mask reduces, causing a shift in electron beam landing due to the dent to move toward the central portion of the screen.

In contrast to this, with the mask frame 30 in the embodiment of FIG. 11, because it has the second slits 32, the stiffness at various positions on the mask fixing sections 33, 34 is substantially uniform, with the result that the tension distribution remains unchanged even when the shadow mask 20 has expanded thermally, and consequently the landing characteristic of the electron beam is not degraded.

Furthermore, in the embodiment, even when the stiffness of the mask fixing sections 33, 34 is not made uniform enough to prevent miss landing, beam landing changes during projection of electron beams can be alleviated. Specifically, the thermal expansion of the shadow mask 20 during projection of electron beams itself causes landing changes of electron beams toward outside the screen. By changing the length, width, etc. of the second slit 32, a change in the tension distribution on the shadow mask during the thermal expansion of the shadow mask is adjusted, which thereby reduces the amount of dent in the shadow mask during the thermal expansion of the shadow mask, and alleviates the change of landing.

While in the first to third embodiments, each mask fixing section is formed of a plate material with a constant thickness and the second slits that separate the sidewalls of the mask body from the mask fixing sections are each formed into a belt shape with a constant width, the thickness of the mask fixing section may be changed or the width of the second slit may be changed as shown in the embodiments which will be explained below.

FIG. 18 and FIGS. 19A to 19C show a fourth embodiment where a mask unit 21 is constructed in such a manner that with tension applied to a flat, rectangular shadow mask 20 in the Y direction, the shadow mask is secured to a mask frame 30. The mask frame 30 comprises a rectangular frame body 37, and a pair of mask fixing sections 33, 34 to which the side edge portions of the long sides of the shadow mask 20 are welded. These mask fixing sections 33 and 34 are provided on two sidewalls 37*a*, 37*b* of the frame body 37 facing each other so as to stand upright via connecting portions 38.

In the fourth embodiment, each of the mask fixing sections 33, 34 is formed so that the plate becomes thicker gradually from both longitudinal end portions toward the middle portion. The outside surfaces of the respective fixing sections take the form of an arc projecting in the direction in which one mask fixing section separates away from the other. In the sidewalls 37*a*, 37*b* of the frame body 37, second slits 32 extending from both ends of each sidewall toward the middle portion thereof are formed into a belt shape with a constant width.

Here, the remaining configuration is the same as that in the above-described embodiments. The same parts are indicated by the same reference numerals and a detailed explanation of them will be omitted.

With the fourth embodiment thus constructed, each of the mask fixing sections 33, 34 is formed in such a manner that its middle portion is the thickest and gets thinner gradually toward both longitudinal end portions. Therefore, each of the mask fixing sections 33, 34 can be substantially uniform in the longitudinal direction, although the stiffness of each sidewall of the frame body 37 is higher at both end portions than at the middle portion. Accordingly, as with the aforementioned embodiments, it is possible to prevent wrinkles from developing near the corners of the shadow mask 20 and provide a color cathode-ray tube with a high color purity.

Figure 20:
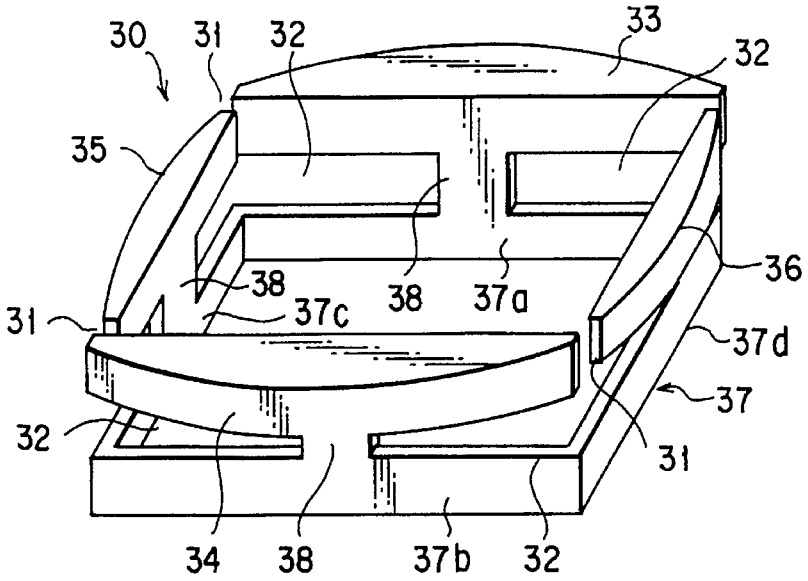
FIG. 20 is a perspective view of a mask frame according to a fifth embodiment of the present invention.

FIG. 20 shows a mask frame 30 according to a fifth embodiment of the present invention, where the shadow mask 20 is supported, with being applied with tension in the X and Y directions. The mask frame 30 is similar to the mask frame of the fourth embodiment, but further provided with a pair of mask fixing sections 35, 36 to which both end portions of the short sides of the shadow mask 20 are welded. Each of the mask fixing sections 35, 36 is formed so that the plate may be thicker gradually from both longitudinal end portions toward the middle portion. The remaining configuration is the same as that of the fourth embodiment.

The fifth embodiment thus constructed also produces similar effects to those with the fourth embodiment.

Figure 21:
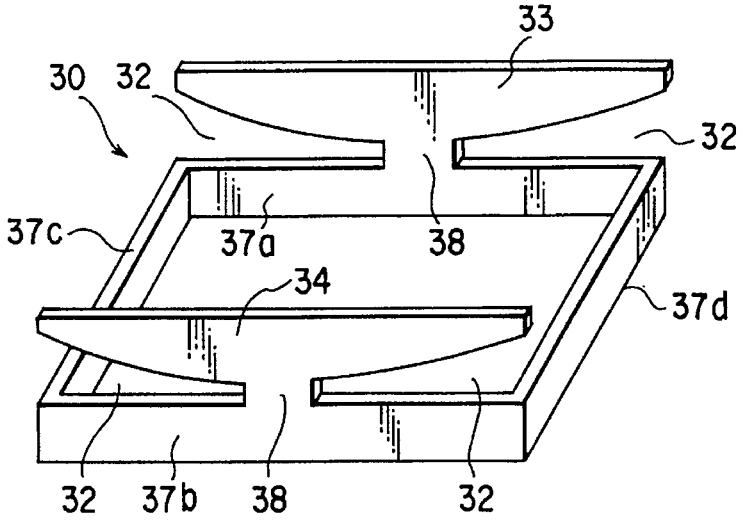
FIG. 21 is a perspective view of a mask frame according to a sixth embodiment of the present invention.

FIG. 21 shows a mask frame 30 according to a sixth embodiment of the present invention, where the shadow mask 20 is supported, with being applied with tension in one direction, for example, in the Y direction. According to the sixth embodiment, the mask frame 30 is provided with a pair of mask fixing sections 33, 34 to which both side edge portions of the long sides of the shadow mask 20 are welded. Each mask fixing section is formed so as to have a constant thickness. In this embodiment, second slits 32 forming a pair and extending from both ends of each sidewall of the frame body 37 toward the longitudinal middle portion, are each formed so as to get wider gradually from the vicinity of the connecting portion 38 of the mask fixing section toward the longitudinal ends of the mask fixing section.

With the sixth embodiment thus constructed, by making each second slit 32 wider gradually toward the longitudinal ends of the mask fixing section, the stiffness of each mask fixing section can be made uniform in the longitudinal direction, thereby producing similar effects to those with the above embodiments.

Figure 22:
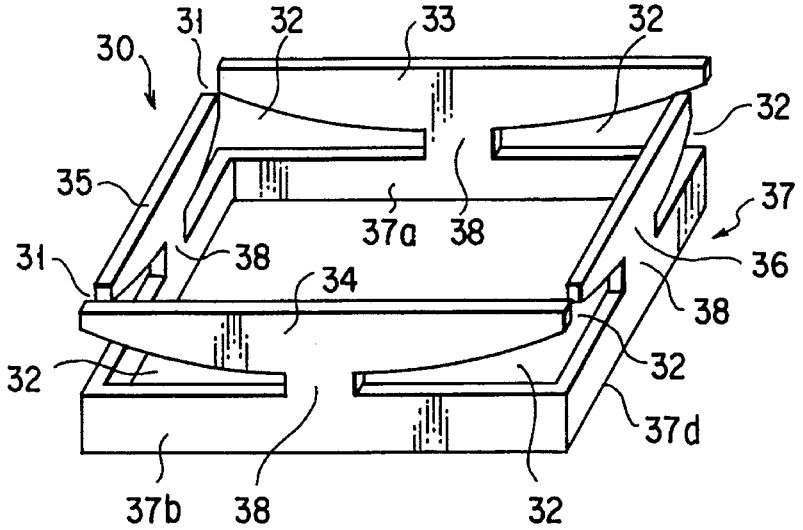
FIG. 22 is a perspective view of a mask frame according to a seventh embodiment of the present invention.

FIG. 22 shows a mask frame 30 according to a seventh embodiment of the present invention, where the shadow mask 20 is supported with being applied with tension in the X and Y directions. The mask frame 30 is similar to the mask frame of the sixth embodiment, but further provided with a pair of mask fixing sections 35, 36 to which both side edge portions of the short sides of the shadow mask 20 are welded. The respective mask fixing sections 35, 36 are partially separated from the sidewalls 37*c*, 37*d* of the frame body 37 by a pair of second slits 32 and provided so as to stand upright on the middle portions of the corresponding sidewalls via connecting portions 38. In this embodiment, too, each of the mask fixing sections 35, 36 is formed so as to have a constant plate thickness, and each second slit 32 is formed so as to get wider gradually from the vicinity of the connecting portion 38 of the mask fixing section toward the longitudinal end of the mask fixing section.

The seventh embodiment thus constructed also produces similar effects to those with the sixth embodiment.

While in the fourth and sixth embodiments, the distal end edge of each mask fixing section to which the shadow mask is secured is made flat, the distal end edge of the mask fixing section may be formed into an arcuate shape and the shadow mask may be secured and supported in a curved state as in the embodiment shown in FIG. 11.

FIGS. 23 to 27B show embodiments where the mask fixing section is provided with a protrusive section or a reinforcing member.

Figure 23:
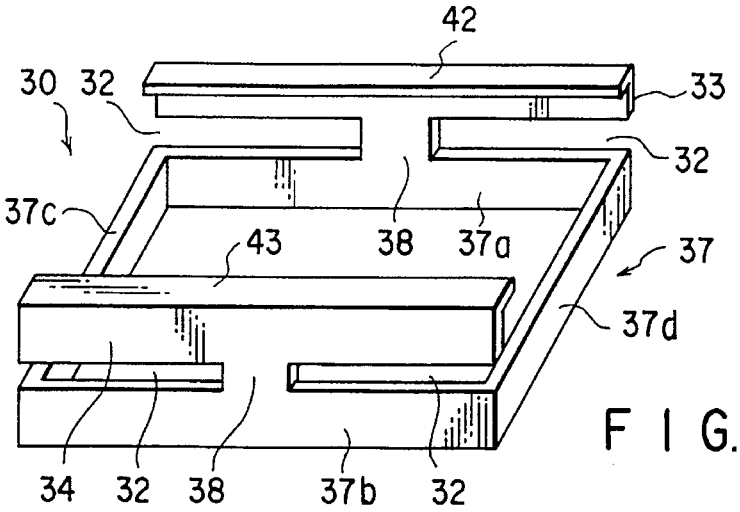
FIG. 23 is a perspective view of a mask frame according to a eighth embodiment of the present invention.

In an eighth embodiment of the invention shown in FIG. 23, a pair of mask fixing sections 33, 34 to which the side edge portions of the long sides of the shadow mask 20 are welded is coupled with a pair of sidewalls 37*a*, 37*b* facing each other of a rectangular frame body 37 via connecting sections 38. The mask fixing sections 33, 34 are formed into rectangular plates extending in parallel with the sidewalls 37*a*, 37*b* of the frame body 37, respectively. Both longitudinal end portions of each mask fixing section except for the connecting portion 38 are separated from the corresponding sidewall of the frame body 37 by a pair of second slits 32.

Furthermore, in this embodiment, the distal end portions or the tip portions of the mask fixing sections 33, 34 are bent at almost right angles toward the other mask fixing section to form elongated rectangular protrusive sections 42, 43, respectively. The side edge portions of the long sides of the shadow mask are welded to the respective protrusive sections 42, 43, and supported by the mask frame 30 with tension applied in the Y direction. In this embodiment, the same parts as those in the above embodiments are indicated by the same reference numerals and a detailed explanation of them will not be given.

With the eighth embodiment thus constructed, the second slits 32 enable the stiffness of each mask fixing section to be substantially uniform in the longitudinal direction. Furthermore, the protrusive sections 42, 43 enable the stiffness of each mask fixing section to be substantially uniform over the entire area in the longitudinal direction. Therefore, it is possible to prevent not only wrinkles from developing in the shadow mask in the manufacture of color cathode-ray tubes, but also the respective mask fixing sections 33, 34 from being deformed due to tension of the shadow mask. As a result, it is possible to provide a color cathode-ray tube less liable to degradation of color purity.

Figure 24A:
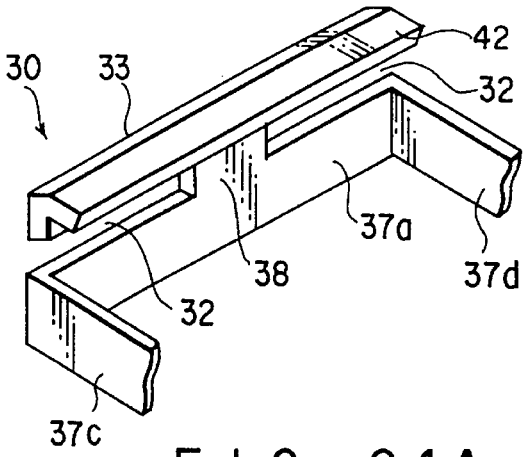
FIGS. 24A and 24B are perspective views showing different modifications of the bulging portion in the eighth embodiment, respectively.
Figure 24B:
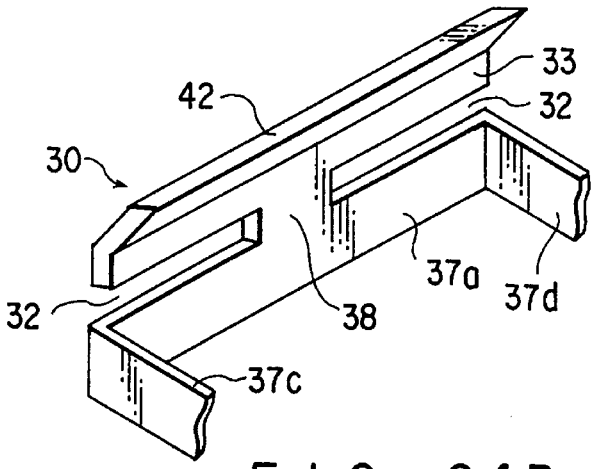
Figure 25:
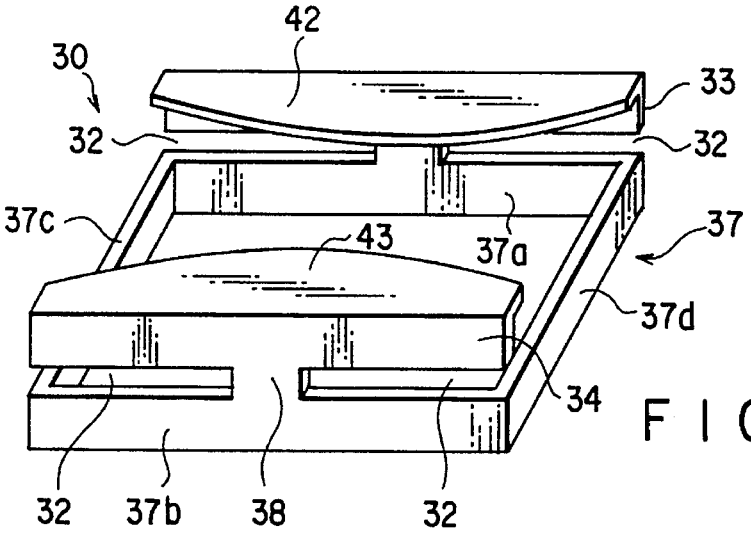
FIG. 25 is a perspective view of a mask frame according to a ninth embodiment of the present invention.

While in the eighth embodiment, the protrusive sections 42, 43 of the respective mask fixing sections 33, 34 extend at right angles to the mask fixing sections, each protrusive section, for example, the protrusive section 42, may extend downward at an acute angle as shown in FIG. 24A, or upward at an acute angle as shown in FIG. 24B. In both cases, the same result can be obtained as with the eighth embodiment.

Furthermore, the protrusive sections 42, 43 are not limited to a rectangle. The extended edge of the protrusive portion may be formed in an arcuate shape which projects toward the other protrusive section as in a ninth embodiment of the invention shown in FIG. 25. In this case, the protrusive sections 42, 43 enhance the stiffness of the middle portions of the mask fixing sections 33, 34, thereby making the stiffness of each mask fixing section more uniform in the longitudinal direction.

Figure 26:
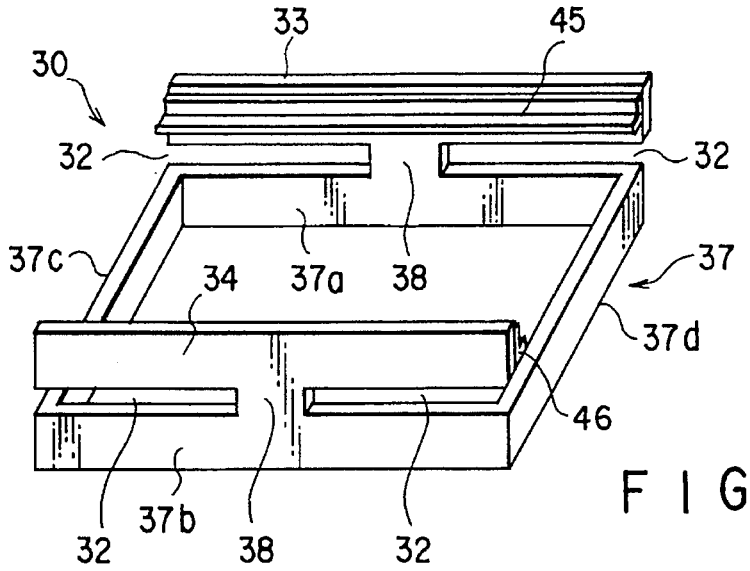
FIG. 26 is a perspective view of a mask frame according to a tenth embodiment of the present invention.

With a tenth embodiment of the present invention shown in FIG. 26, instead of the protrusive sections 42, 43, elongated belt-like reinforcing members 45, 46 are welded to a pair of mask fixing sections 33, 34, respectively. The reinforcing members 45, 46 have an L-shaped cross section and extend over the full length of the mask fixing sections 33, 34.

With the tenth embodiment thus constructed, the reinforcing members 45, 46 enable the stiffness of each mask fixing section to be almost uniform over the entire area in the longitudinal direction. Therefore, it is possible to prevent not only wrinkles from developing in the shadow mask in the manufacture of color cathode-ray tubes, but also the respective mask fixing sections 33, 34 from being deformed due to tension of the shadow mask. As a result, it is possible to provide a color cathode-ray tube less liable to degradation of color purity.

Figure 27A:
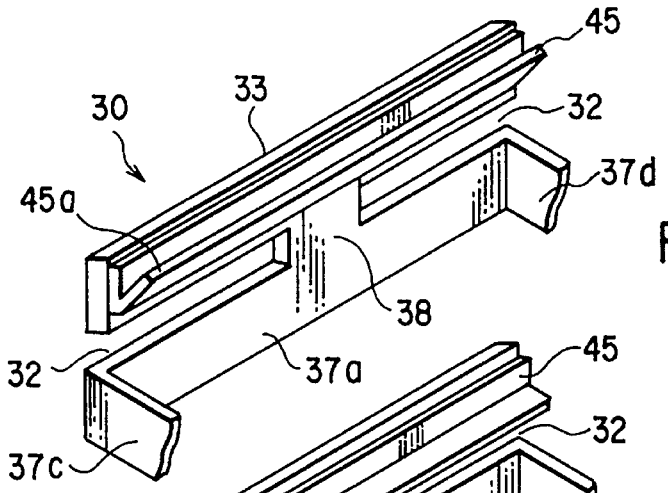
FIGS. 27A and 27B are perspective views showing different modifications of the bulging portion in the tenth embodiment, respectively.
Figure 27B:
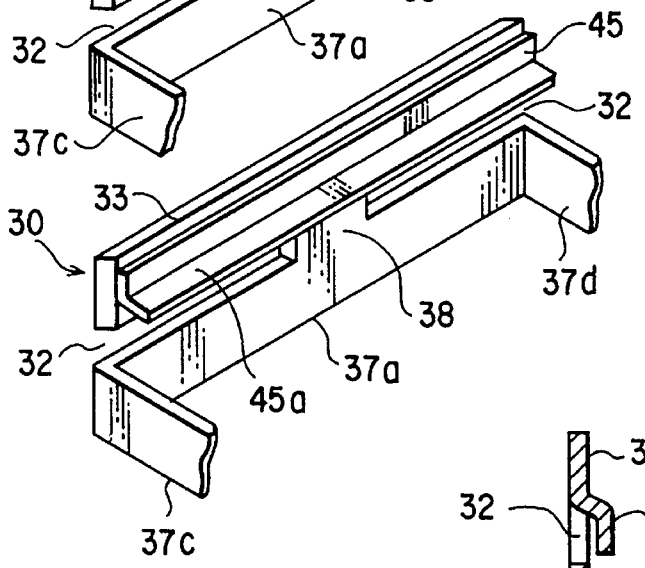

While in the tenth embodiment, the respective reinforcing members 45, 46 are formed so as to have an L-shaped cross section to form a protrusive section at right angles with the mask fixing section, each reinforcing member, for example, the reinforcing member 45, may have an extending section 45*a* that protrudes downward at an acute angle as shown in FIG. 27A, or an extending section 45*a* that protrudes upward at an acute angle as shown in FIG. 27B. These cases also produce the same effect as with the tenth embodiment.

In FIG. 26 and FIGS. 27A and 27B, the same parts as those in the above embodiments are indicated by the same reference numerals, and a detailed explanation of them will not be given.

Figure 28:
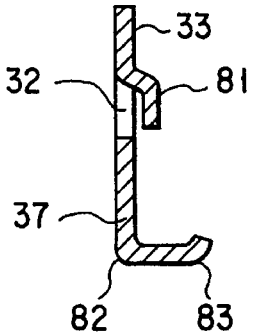
FIG. 28 is a sectional view showing a part of a mask frame according to a eleventh embodiment of the present invention.

In the above-described embodiments, the mask fixing sections and frame body have a flat cross section. The structure of the mask fixing section is not limited to what has been explained in the above embodiments. For example, the mask fixing section may have the following structure: as shown in FIG. 28, the frame body 37 and mask fixing sections 33, 34, 35, 36 may be provided with bent portions 81, 82, 83, 84. Use of bent portions increases enables the strength of the frame body and mask fixing sections. Therefore, it is possible to form the mask frame 30 into a lighter structure with a smaller thermal capacity, thereby making smaller the difference in cooling speed between the shadow mask and the mask frame in a high-temperature furnace in the manufacturing process.

While in the above embodiments, the mask frame 30 has been integrally formed, it may be formed in such a manner that after the frame body and the mask fixing sections have been composed of different members, these are connected to each other using connecting sections into a unity.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode-ray tube comprising:

a face panel;

a phosphor screen formed on an inner surface of the face panel;

an electron gun facing the phosphor screen, the electron gun emitting a plurality of electron beams toward the phosphor screen; and a mask unit positioned between the face panel and the electron gun, the mask unit including a shadow mask formed of a substantially rectangular thin plate, the mask unit facing the phosphor screen and having a number of electron beam apertures through which the electron beams pass and a pair of side edge portions facing each other, and a mask frame supporting the shadow mask with tension applied to the shadow mask, the mask frame comprising a substantially rectangular frame body having a pair of first sidewalls facing each other and a pair of second sidewalls facing each other, each of the pair of first sidewalls including a base section continuous with the second sidewalls, a mask fixing section secured to one of the side edge portions of the shadow mask and separated from the second sidewalls, and a connecting section connecting a longitudinal middle portion of the base section to a longitudinal middle portion of the mask fixing section and having a width in the longitudinal direction of the base section which is smaller than the longitudinal length of the base section.

2. A color cathode-ray tube according to claim 1, wherein each of the mask fixing sections has a flat distal end portion, and each of said pair of side edge portions of the shadow mask is secured to the distal end portion.

3. A color cathode-ray tube according to claim 1, wherein each of the mask fixing sections has an arcuated distal end portion curved convexly, and each of the pair of side edge portions is secured to the arcuated distal end portion and supported in a curved state by the mask frame.

4. A color cathode-ray tube according to claim 1, wherein the frame body has a pair of slits which extend from both end portions of each of the first sidewall toward a middle portion of the first sidewall so as to separate both end portions of the base section from the mask fixing section, and to define the connecting section.

5. A color cathode-ray tube according to claim 4, wherein each of the slits has a constant width from the end portion of the first sidewall toward the middle portion of the first sidewall.

6. A color cathode-ray tube according to claim 4, wherein each of the narrows from the end portion of the first sidewall toward the middle portion of the first sidewall.

7. A color cathode-ray tube according to claim 1, wherein each of the mask fixing sections is formed of a plate-like member with a constant thickness.

8. A color cathode-ray tube according to claim 7, wherein each of the mask fixing sections has a protruding section that extends toward another mask fixing section.

9. A color cathode-ray tube according to claim 8, wherein each protruding section has an arcuate extended edge curved convexly.

10. A color cathode-ray tube according to claim 7, wherein the mask frame is provided with reinforcing members secured to respective mask fixing sections.

11. A color cathode-ray tube according to claim 10, wherein each reinforcing member is formed into an elongated shape and extends almost over the full length of the respective mask fixing section.

12. A color cathode-ray tube according to claim 1, wherein the mask fixing sections increase in thickness from both longitudinal ends toward a middle portion of the mask fixing section.

13. A color cathode-ray tube according to claim 1, wherein the shadow mask has a second pair of side edge portions which extend in a direction substantially perpendicular to the pair of side edge portions, and each of the second sidewalls includes a base section continuous with the first sidewalls, a second mask fixing section being secured to one of the second pair of the edge portions of the shadow mask being separated from the first sidewalls, and a second connecting section connecting a longitudinal middle portion of the base section to a longitudinal middle portion of the second mask fixing section and having a width in the longitudinal direction of the base section which is smaller than the longitudinal length of the base section.

14. A color cathode-ray tube comprising:

a face panel;

a phosphor screen formed on an inner surface of the face panel;

an electron gun facing the phosphor screen, the electron gun emitting a plurality of electron beams toward the phosphor screen; and a mask unit positioned between the face panel and the electron gun, the mask unit including a shadow mask formed of a substantially rectangular thin plate, the mask unit facing the phosphor screen and having multiple electron beam apertures through which the electron beams pass and a pair of side edge portions facing each other, and a mask frame supporting the shadow mask with tension applied to the shadow mask, the mask frame comprising a substantially rectangular frame body which has a pair of second sidewalls facing each other, each of the first sidewalls including a base section continuous with the second sidewalls, a mask fixing section secured to one of the side edge portions of the shadow mask and separated from the second sidewalls, and a connecting section connecting a longitudinal middle portion of the base section to a longitudinal middle portion of the mask fixing section and having a width in the longitudinal direction of the base section which is smaller than the longitudinal length of the base section, the mask fixing sections standing upright on the base section of one of the first sidewalls respectively, each of the first sidewalls having a pair of slits which extend from both ends of the first sidewall toward a middle portion of the first sidewall so as to separate both end portions of a corresponding one of the mask fixing sections from both end portion a corresponding one of the base sections, each of the mask fixing sections having an arcuate distal end edge curved convexly, the pair of side edge portions of the shadow mask being secured to the distal end edges of the mask fixing sections and supported in a curved state by the mask frame.

15. A color cathode-ray tube comprising:

a face panel;

a phosphor screen formed on an inner surface of the face panel;

an electron gun facing the phosphor screen, the electron gun emitting a plurality of electron beams toward the phosphor screen; and a mask unit positioned between the face panel and the electron gun, the mask unit including a shadow mask formed of a substantially rectangular thin plate facing the phosphor screen and having multiple electron beam apertures through which the electron beams pass and a pair of side edge portions facing each other, and a mask frame supporting the shadow mask with tension applied to the shadow mask, the mask frame shaped in a substantially rectangular tube having four continuous sidewalls and arranged coaxially with a tube axis of the cathode-ray tube;

the mask frame having first slits which are formed in the four corners of the mask frame and which extend from one longitudinal end of the mask frame to a middle portion of each corner in an axial direction of the mask frame, respectively, and second slits extending from an extended end of each of the first slits to middle portions of two adjacent sidewalls which define the corner, the first and second slits defining a substantially rectangular frame body with four sidewalls, each sidewall having a base section continuous with an adjacent sidewall, a fixing section independent from the adjacent sidewall, and a connecting section connecting a longitudinal middle portion of the base section to a longitudinal middle portion of the fixing section and having a width in the longitudinal direction of the base section which is smaller than the longitudinal length of the base section, and the shadow mask having four side edge portions fixed to the respective mask fixing sections.

* * * * *